US009067293B2

(12) United States Patent
Bernardi et al.

(10) Patent No.: US 9,067,293 B2
(45) Date of Patent: Jun. 30, 2015

(54) ACCESSORY CLAMP FOR A POWER TOOL

(75) Inventors: Walter Bernardi, Highland Park, IL (US); Brian Knoles, Springfield, IL (US)

(73) Assignee: Robert Bosch GmbH, Stuttgart (DE)

( * ) Notice: Subject to any disclaimer, the term of this patent is extended or adjusted under 35 U.S.C. 154(b) by 809 days.

(21) Appl. No.: 13/250,509

(22) Filed: Sep. 30, 2011

(65) Prior Publication Data

US 2013/0082449 A1 Apr. 4, 2013

(51) Int. Cl.

| | |
|---|---|
| ***B23B 31/02*** | (2006.01) |
| ***B24B 23/02*** | (2006.01) |
| ***B24B 23/04*** | (2006.01) |
| ***B24B 45/00*** | (2006.01) |

(52) U.S. Cl.

CPC ..... *B24B 23/022* (2013.01); *Y10T 279/33* (2015.01); *Y10T 279/3451* (2015.01); *B24B 23/04* (2013.01); *B24B 45/006* (2013.01)

(58) Field of Classification Search

CPC ..... B24B 23/002; B24B 45/006; B24B 23/04
USPC ..... 279/141, 150; 83/698.11, 782, 597, 83/697; 30/330, 339, 331; 451/356, 357, 451/359

See application file for complete search history.

(56) References Cited

U.S. PATENT DOCUMENTS

| | | | | |
|---|---|---|---|---|
| 4,779,382 | A * | 10/1988 | Rudolf et al. | 451/342 |
| 5,489,285 | A | 2/1996 | Goris | |
| 5,601,483 | A | 2/1997 | Rudolf et al. | |
| 6,569,001 | B2 | 5/2003 | Rudolf et al. | |
| 6,638,151 | B2 * | 10/2003 | Ueno | 451/359 |
| 6,910,694 | B2 * | 6/2005 | Hartmann et al. | 279/141 |
| 2003/0190877 | A1 * | 10/2003 | Gallagher et al. | 451/344 |
| 2010/0197208 | A1 | 8/2010 | Blickle et al. | |
| 2012/0074657 | A1 * | 3/2012 | Zhou | 279/128 |

FOREIGN PATENT DOCUMENTS

| | | | |
|---|---|---|---|
| DE | 3405885 | C1 | 1/1986 |
| EP | 0253181 | A2 | 1/1988 |
| EP | 0495181 | A1 | 7/1992 |
| WO | 2005063439 | A1 | 7/2005 |

OTHER PUBLICATIONS

International Search Report and Written Opinion in corresponding PCT application (i.e., PCT/US2012/057786), mailed Jul. 10, 2013 (10 pages).

* cited by examiner

*Primary Examiner* — Eric A Gates
*Assistant Examiner* — Chwen-Wei Su
(74) *Attorney, Agent, or Firm* — Maginot Moore & Beck LLP

(57) ABSTRACT

A clamping device for clamping an accessory to a power tool includes a first flange, a spindle member, and a cam member. The first flange is coupled to a drive system of the power tool and is configured to receive the accessory. The spindle member defines a longitudinal axis and includes a second flange provided on an end of the spindle member and a follower member provided on an opposite end of the spindle member. The cam member includes a cam surface configured to interact with the follower surface, the cam member is rotatable about the longitudinal axis to a clamped position and to an unclamped position. In the unclamped position the accessory is removable from the first flange, and in the clamped position the accessory is clamped between the first flange and the second flange.

12 Claims, 12 Drawing Sheets

ACCESSORY CLAMP FOR A POWER TOOL

FIELD

This patent relates generally to power tools and particularly to a clamp for clamping an accessory to a power tool.

BACKGROUND

Oscillating tools are handheld power tools used by professional craftsmen, handymen, and hobbyists. The typical oscillating tool is a handheld tool configured for use with a variety of accessory bits/tools that can be used for cutting, carving, drilling, sanding, polishing, and many other applications. One specific example of an oscillating tool is the Dremel® Multi-Max™ oscillating tool, which is sold by the Robert Bosch Tool Corporation.

The typical oscillating tool includes a housing that encloses an electric motor. Rotation of the motor is coupled to a transmission, which converts the rotation into oscillating movement. An accessory tool holder extends from a front portion of the housing and is coupled to the transmission, such that the tool holder oscillates when the motor is coupled to a supply of electrical energy. In particular, the tool holder, and any accessory bit connected thereto, oscillates through a range of movement of about two degrees (2°) to three degrees (3°) at a frequency of approximately 350 Hz. Typically, the oscillations cause a working portion of the accessory bit to move in a controlled side-to-side motion, which produces minimal dust during cutting operations.

The accessory bit is typically connected to the accessory tool holder with a removable fastening member and a washer. The fastening member is removed from the tool holder with a separate hand tool when a user desires to change or replace the accessory bit. The fastening member and the washer are reconnected to the tool holder with the separate hand tool when the replacement accessory bit is positioned on the accessory tool holder.

The fastening member works well to secure the accessory tool to the accessory tool holder. Frequently, however, the separate hand tool is small and easily misplaced. Additionally, users typically desire to change the accessory bit quickly to reduce the amount of time spent configuring the oscillating tool.

Therefore, it is desirable to provide an accessory tool holder, which securely connects to the accessory bit, does not require the use of a separate hand tool, and that is quickly configured when the user desires to change or replace the accessory tool.

SUMMARY

According to one embodiment of the disclosure, a clamping device for clamping an accessory to a power tool includes a first flange, a spindle member, and a cam member. The first flange is coupled to a drive system of the power tool and is configured to receive the accessory. The spindle member defines a longitudinal axis and includes a second flange provided on an end of the spindle member and a follower member provided on an opposite end of the spindle member. The cam member includes a cam surface configured to interact with the follower surface, the cam member is rotatable about the longitudinal axis to a clamped position and to an unclamped position. In the unclamped position the accessory is removable from the first flange, and in the clamped position the accessory is clamped between the first flange and the second flange.

According to another embodiment of the disclosure, a clamping device for clamping an accessory to a power tool includes a first clamp member, an actuator, and a second clamp member. The first clamp member is coupled to a drive system of the power tool and configured to receive the accessory. The actuator is rotatable about an axis of rotation to a clamped position and to an unclamped position. The second clamp member is movable in a direction parallel to the axis of rotation. The accessory is clamped between the first clamp member and the second clamp member when the actuator is rotated to the clamped position. The accessory is removable from the first clamp member when the actuator is rotated to the unclamped position.

According to yet another embodiment of the disclosure, a power tool includes a first flange, a spindle member, a cam member, and an eccentric member. The first flange is coupled to a drive system and is configured to receive an accessory tool. The spindle member defines a longitudinal axis and includes a second flange provided on an end of the spindle member. The cam member includes a cam surface configured to interact with an opposite end of the spindle member, the cam member is rotatable about the longitudinal axis to an unclamped position and to a clamped position, in the first position the accessory tool is removable from the first flange, and in the second position the accessory tool is clamped between the first flange and the second flange. The eccentric member defines a spindle opening and a chamfered surface, the spindle member extends through the spindle opening and the chamfered surface is configured to bias the accessory tool against the first flange when the cam member is in the clamped position.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
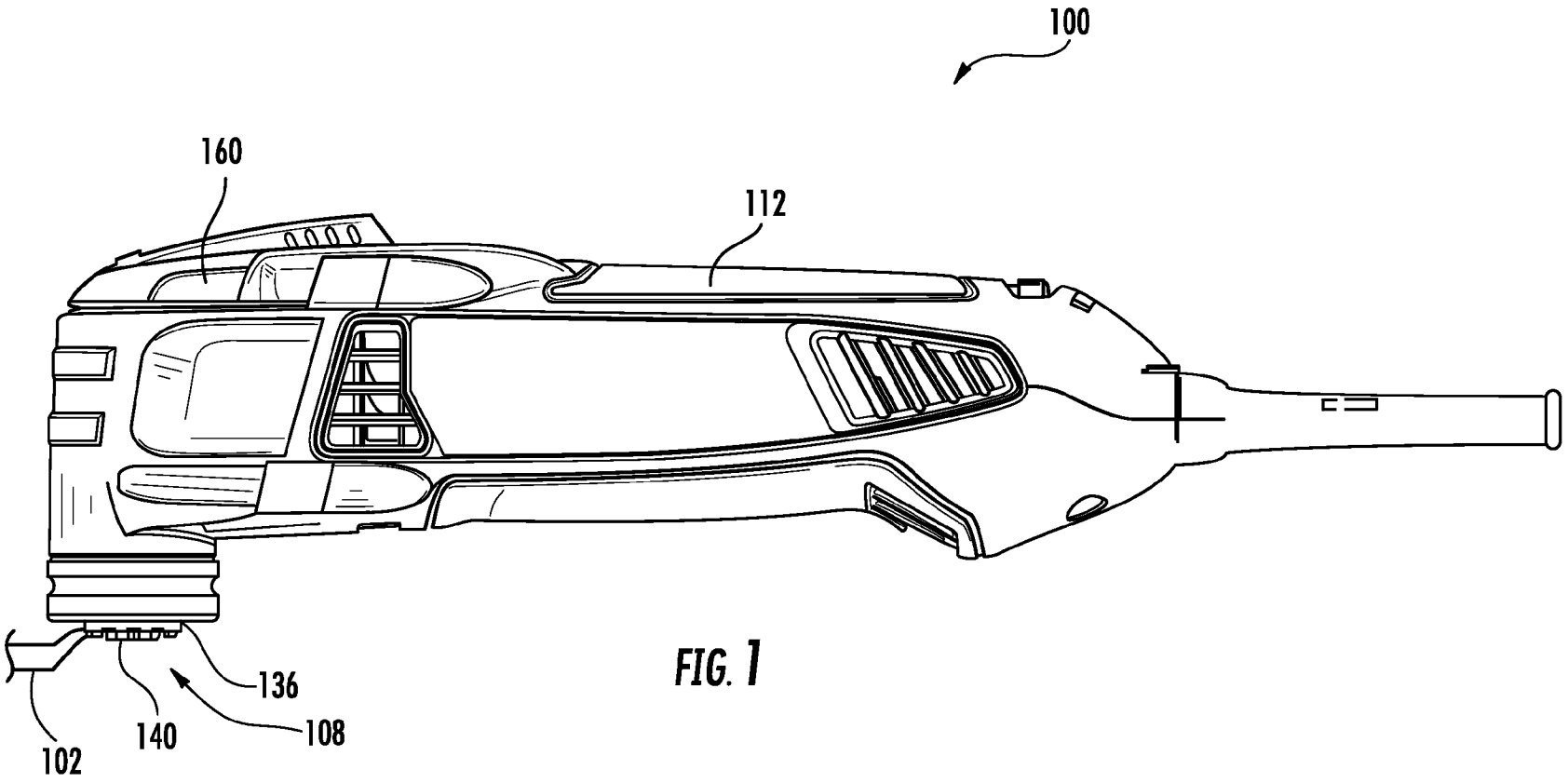
FIG. 1 shows a side elevational view of a power tool according to the present disclosure, the power tool includes a clamping device, which is shown in the clamped position.

For the purpose of promoting an understanding of the principles of the disclosure, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one skilled in the art to which this disclosure pertains.

Figure 2:
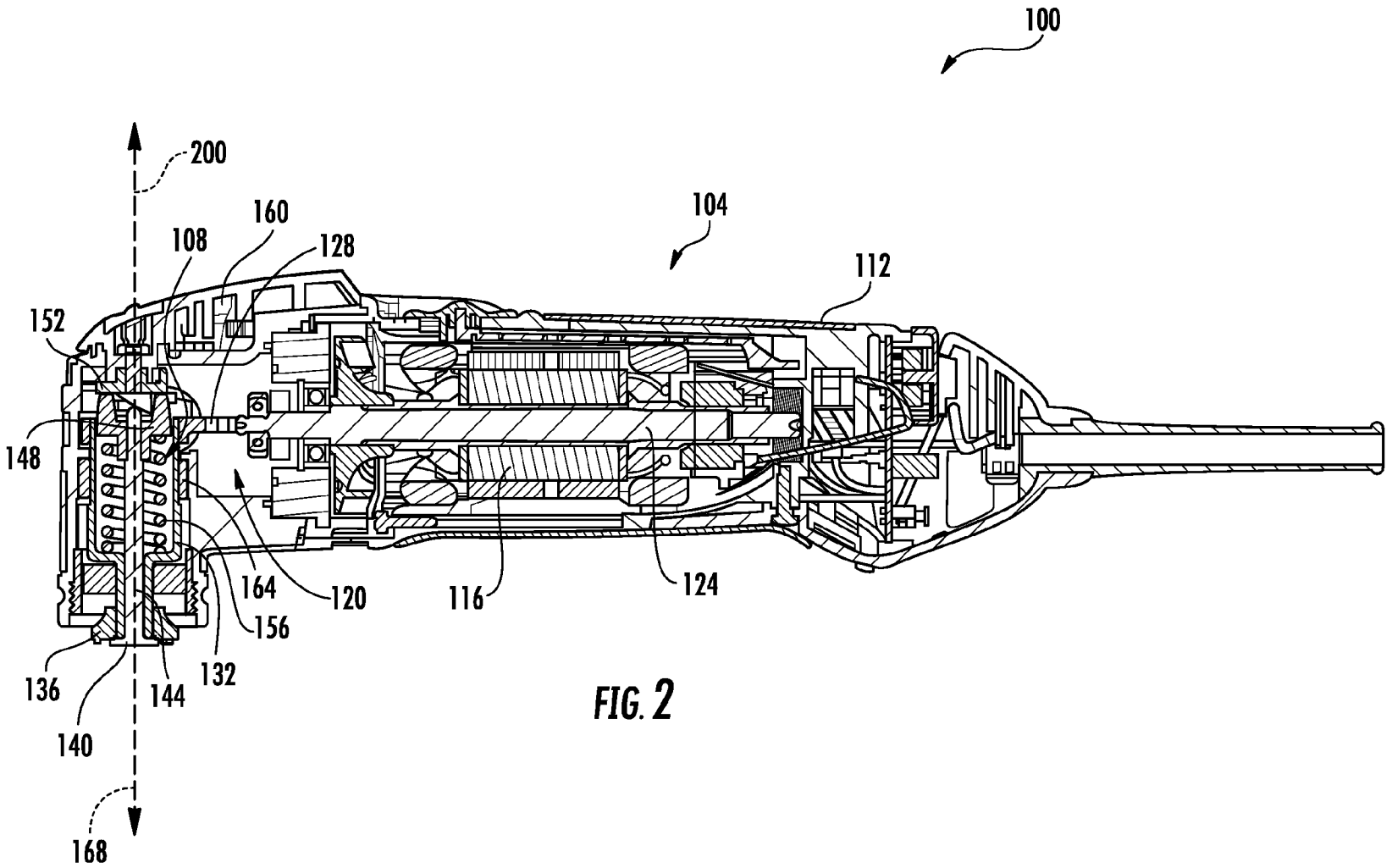
FIG. 2 is a cross sectional view of the power tool of FIG. 1 showing the clamping device in the clamped position without an accessory bit connected thereto.

As shown in FIGS. 1 and 2, a power tool 100 is provided for oscillating/rotating an accessory bit/tool 102. The power tool 100 includes a drive system 104 and a clamping device 108 at least partially positioned within a housing 112. The clamping device 108 is configurable in clamped position and an unclamped position. In the clamped position the clamping device 108 connects the accessory bit 102 to the power tool 100. In the unclamped position the accessory bit 102 is removable from the power tool 100.

The drive system 104 includes an electric motor 116 and a transmission 120. The electric motor 116 includes a motor shaft 124 and is provided as any electric motor known to those of ordinary skill in the art. The transmission 120 is coupled to the motor shaft 124 and includes a drive lever 128. In the embodiment shown in FIG. 2, the transmission 120 converts rotation of the motor shaft 124 into oscillatory movement of the drive lever 128 about an axis of oscillation 168, as will be recognized by those of ordinary skill in the art. A lubricant 130 (FIG. 3), such as grease, is included in the housing 112 and is in contact with the drive lever 128.

Figure 3:
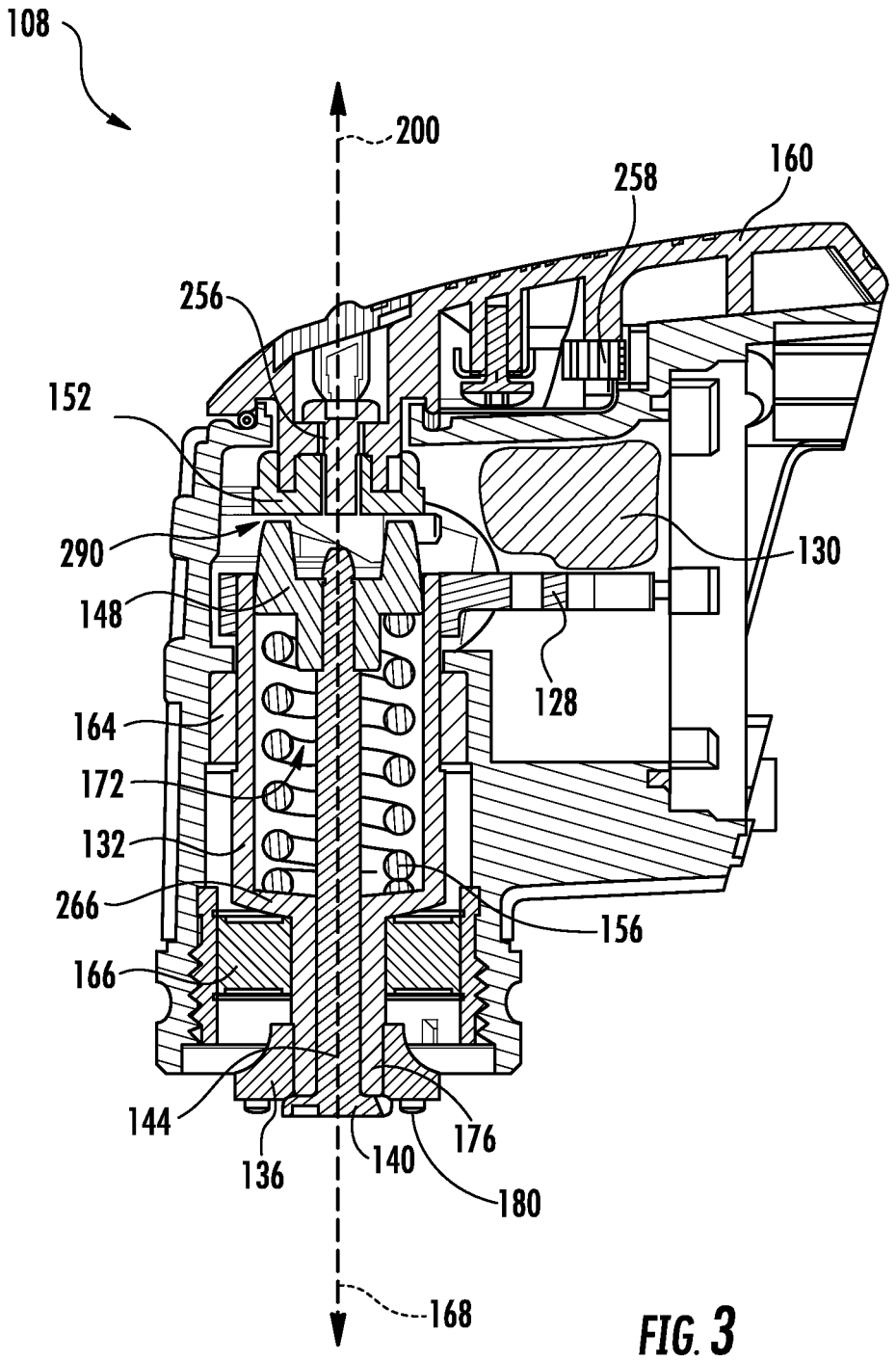
FIG. 3 is a cross sectional view of a front portion of the power tool of FIG. 1 showing the clamping device in the clamped position without the accessory bit connected thereto.

With reference to FIG. 3, the clamping device 108 includes a spool 132, a clamp member provided as an outer flange 136, a clamp member provided as an inner flange 140, a spindle 144, a follower member 148, an actuator provided as a cam 152, a biasing spring 156, and a handle 160. The spool 132 is rotatably supported in the housing 112 by an upper bearing assembly 164 and a lower bearing assembly 166. The upper bearing assembly 164 is provided as a needle bearing assembly, but may be any type of bearing assembly. The lower bearing assembly 166 is provided as a roller bearing, but may also be any type of bearing assembly. The spool 132 defines a cavity 172 in which the biasing spring 156 and the spindle 144 are at least partially positioned. A lower portion 176 of the spool 132 extends from the housing 112. The spool 132 is coupled to the drive lever 128. Accordingly, the spool 132 oscillates about the axis of oscillation 168, along with the drive lever 128, when the motor 116 is energized. Specifically, the spool 132 rotates back and forth through a range of approximately two degrees (2°) to three degrees (3°) of rotation.

As shown in FIG. 3, the outer flange 136 is fixedly connected to the lower portion 176 of the spool 132 and is positioned outside of the housing 112. The outer flange 136 is coupled to the drive system 104 through the spool 132. The outer flange 136 oscillates about the axis of oscillation 168 with the spool 132 and in the same manner as the spool when the electric motor 116 is energized.

Figure 4:
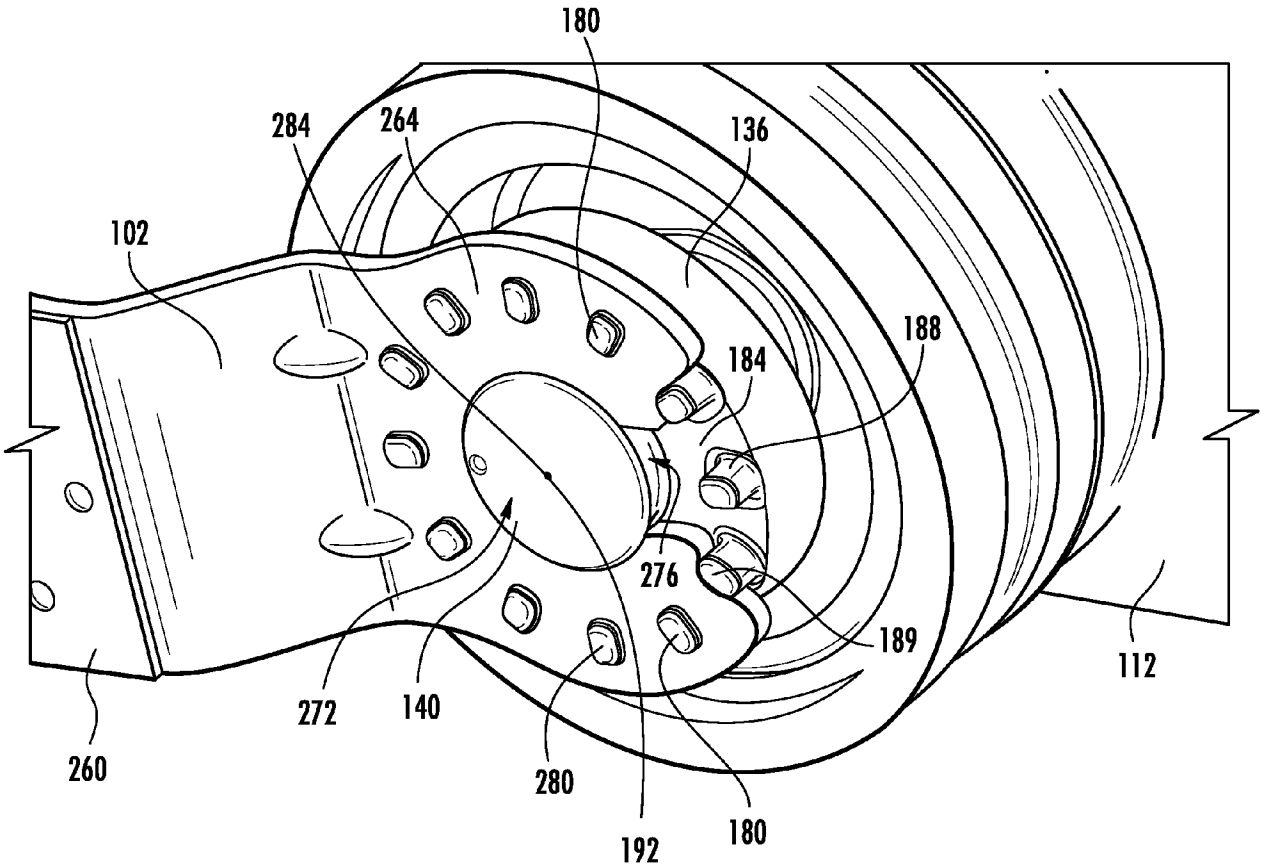
FIG. 4 is perspective view of the front portion of the power tool of FIG. 1, showing the clamping device in the clamped position with an accessory bit/tool connected to the power tool.
Figure 5:
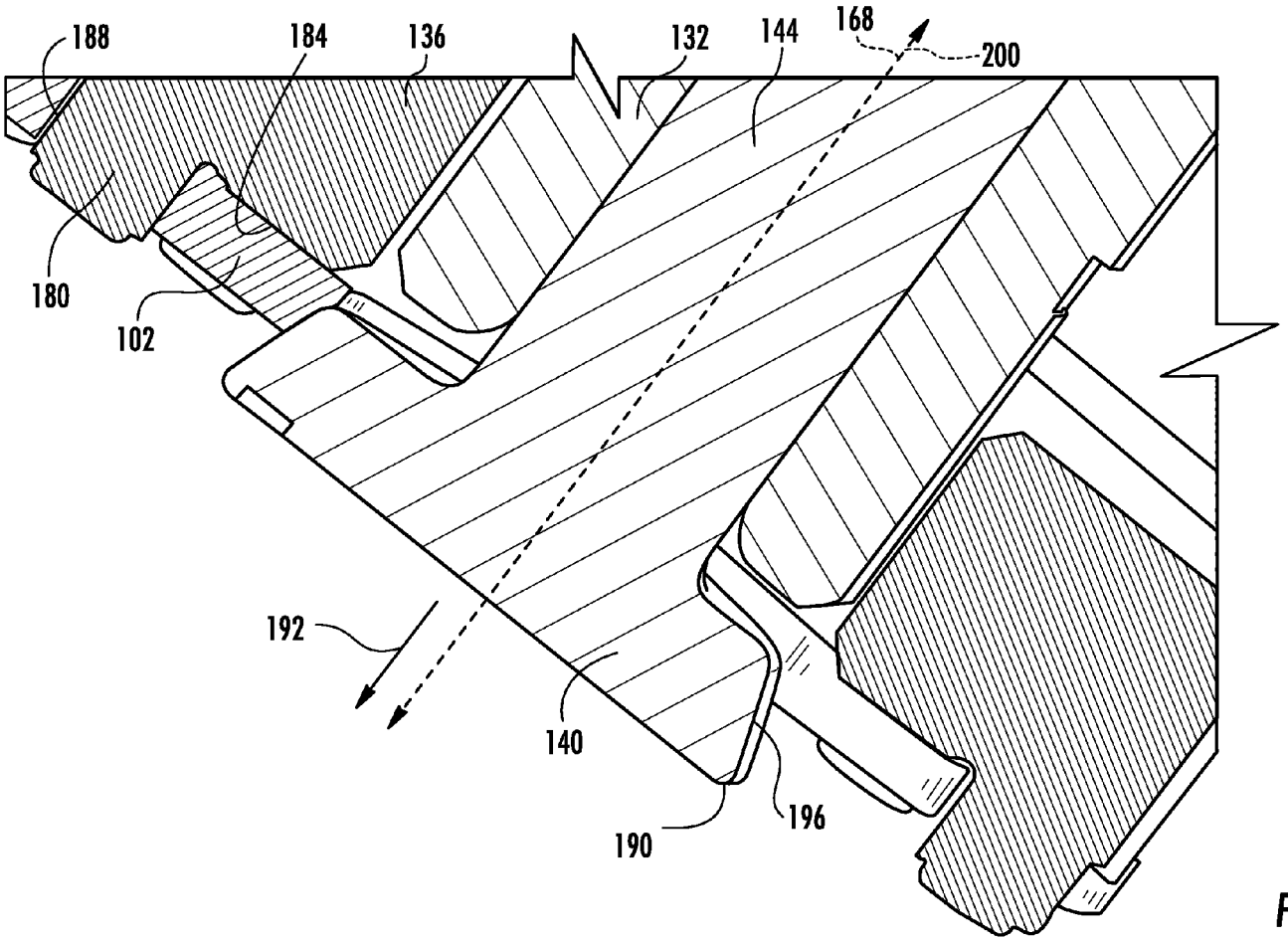
FIG. 5 is a cross sectional view of the front portion of the power tool of FIG. 1, showing an inner flange portion of the clamping device that is offset from a spindle portion of the clamping device.

Referring now to FIG. 4, the outer flange 136 receives the accessory bit 102 and, to this end, includes a plurality of protrusions 180. The protrusions 180 extend away from a contact surface 184 of the flange 136 in a circular pattern centered about the axis of oscillation 168. As shown in FIG. 5, each protrusion 180 has a side surface 188, which is perpendicular to the generally flat contact surface 184, such that a portion of each of the protrusions exhibits a uniform shape as viewed along the axis of oscillation 168. Stated differently, the side surface 188 portion of each protrusion 180 is not tapered. It is noted that a tip portion 189 of each of the protrusions 180 may a rounded over or beveled edge to assist in connecting the accessory bit 102 to the power tool 100. The perpendicular side surfaces 188 enable the outer flange 136 to receive the accessory 102 with very little clearance being exhibited between the accessory and the outer flange.

With reference to FIG. 5, the inner flange 140 is provided on an end of the spindle 144 near the outer flange 136. The inner flange 140 defines a generally circular periphery 190. A center point 192 of the circular periphery 190 is offset from the axis of oscillation 168, such that a greater portion of the inner flange 140 is positioned on one side of the axis of oscillation (i.e. toward the front of the power tool 100) than is positioned on an opposite side of the axis of oscillation (i.e. toward the rear of the power tool 100). The circular periphery 190 has a chamfered edge 196 that engages the accessory bit 102 and biases the accessory bit against the outer flange 136. It is noted that the center point 192 of the inner flange 140 is defined as the center of the circular flange. Other embodiments of the inner flange 140, however, may be non-circular and specifically, may be irregularly shaped. In these embodiments, the center point 192 of the inner flange 140 may be the centroid of the inner flange.

With reference again to FIG. 3, the spindle 144 extends upward from the inner flange 140 through the cavity 172 in the spool 132. The spindle 144 defines a longitudinal axis 200 that is coaxial with the axis of oscillation 168. The spindle 144 and the inner flange 140 are moveable in a direction parallel to the axis of oscillation 168; however, the spindle is fixedly connected to the power tool 100 and is not removable from the power tool during the normal course of operation, including when the accessory bit 102 is removed from the power tool 100.

Figure 6:
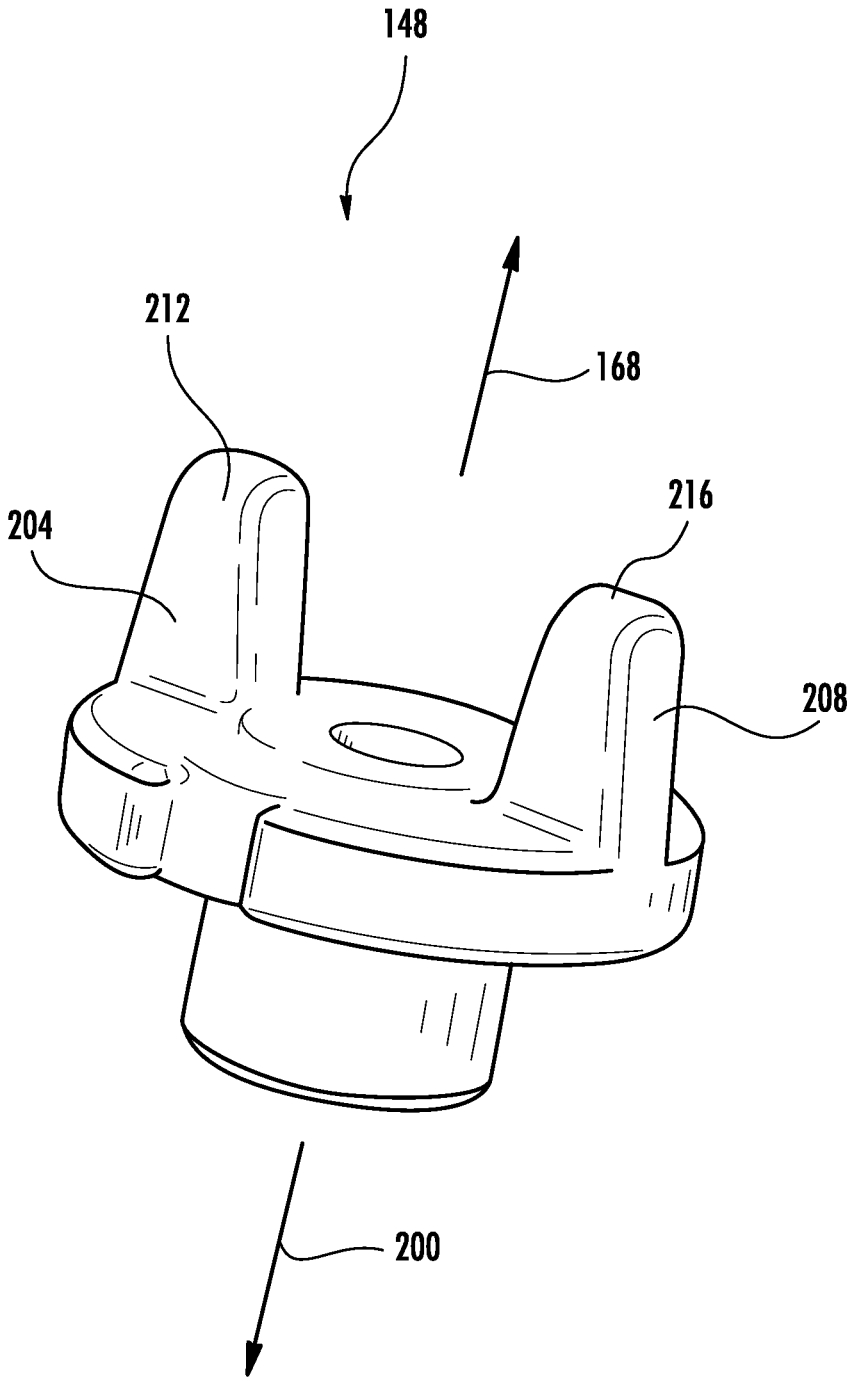
FIG. 6 is a perspective view of a follower member of the clamping device shown in FIG. 3.

As shown in FIG. 3, the follower member 148 is fixed to an upper end of the spindle 144 opposite to the inner flange 140 and extends further outward from the spindle. The follower member 148 is at least partially positioned within the cavity 172 of the spool 132. An isolated perspective view of the follower member 148 is shown in FIG. 6. The follower member 148 is a unitary component and includes a first protrusion 204 and a second protrusion 208 integrally formed therewith. The first protrusion 204 and the second protrusion 208 each have a corresponding follower surface 212, 216 that engages and/or interacts with the cam 152. The follower 148 has a generally circular periphery and the first protrusion 204 is located on a diametrically opposite side from the second protrusion 208.

Figure 7:
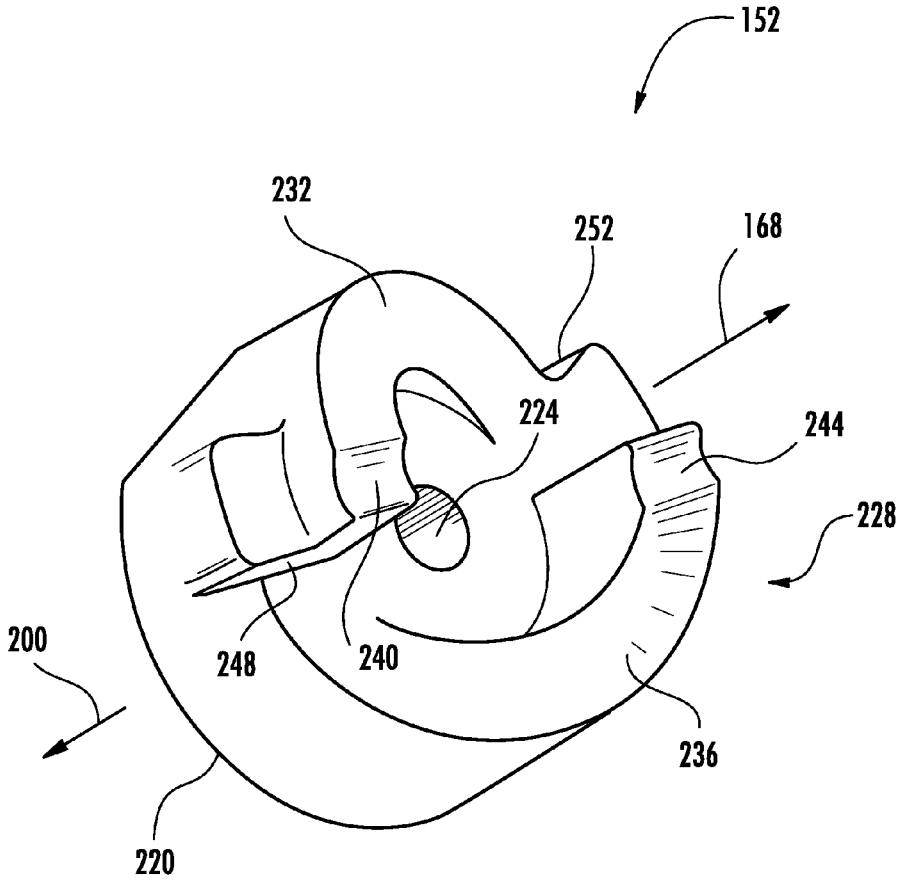
FIG. 7 is a perspective view of a cam member of the clamping device shown in FIG. 3.

Referring again to FIG. 3, the cam 152 of the clamping device 108 is positioned within the housing 112 above the follower member 148 and at least partially within the cavity 172 in the spool 132. An isolated perspective view of the cam 152 is shown in FIG. 7. The cam 152 defines a generally circular periphery 220 having a center point 224 that is aligned with the axis of oscillation 168. The cam 152 includes a cam surface 228 positioned to interact with the follower member 148. The cam surface 228 includes a first inclined surface 232 and a second inclined surface 236. The first inclined surface 232 is positioned to interact with the follower surface 212 of the first protrusion 204, and the second inclined surface 236 is positioned to interact with the follower surface 216 of the second protrusion 208.

The cam 152 further includes a first detent 240, a second detent 244, a first backstop 248, and a second backstop 252. The first detent 240 is positioned at an end of the first inclined surface 232, and the second detent 244 is positioned at an end of the second inclined surface 236. The detents 240, 244 are shaped to receive a corresponding one of the protrusions 204, 208 when the cam 152 is rotated to the unclamped position and to maintain the position of the cam in the unclamped position. The protrusions 204, 208 are released from the detents 240, 244 when the cam 152 begins rotating to the clamped position. The first backstop 248 and the second backstop 252 extend radially outward from the cam 152. Each backstop 248, 252 is positioned to abut a corresponding portion (not shown) of the housing 112 when the cam 152 rotated to the clamped position; thereby, preventing further rotation of the cam. Some embodiments of the cam 152 may not include the backstops 248, 252.

Figure 9:
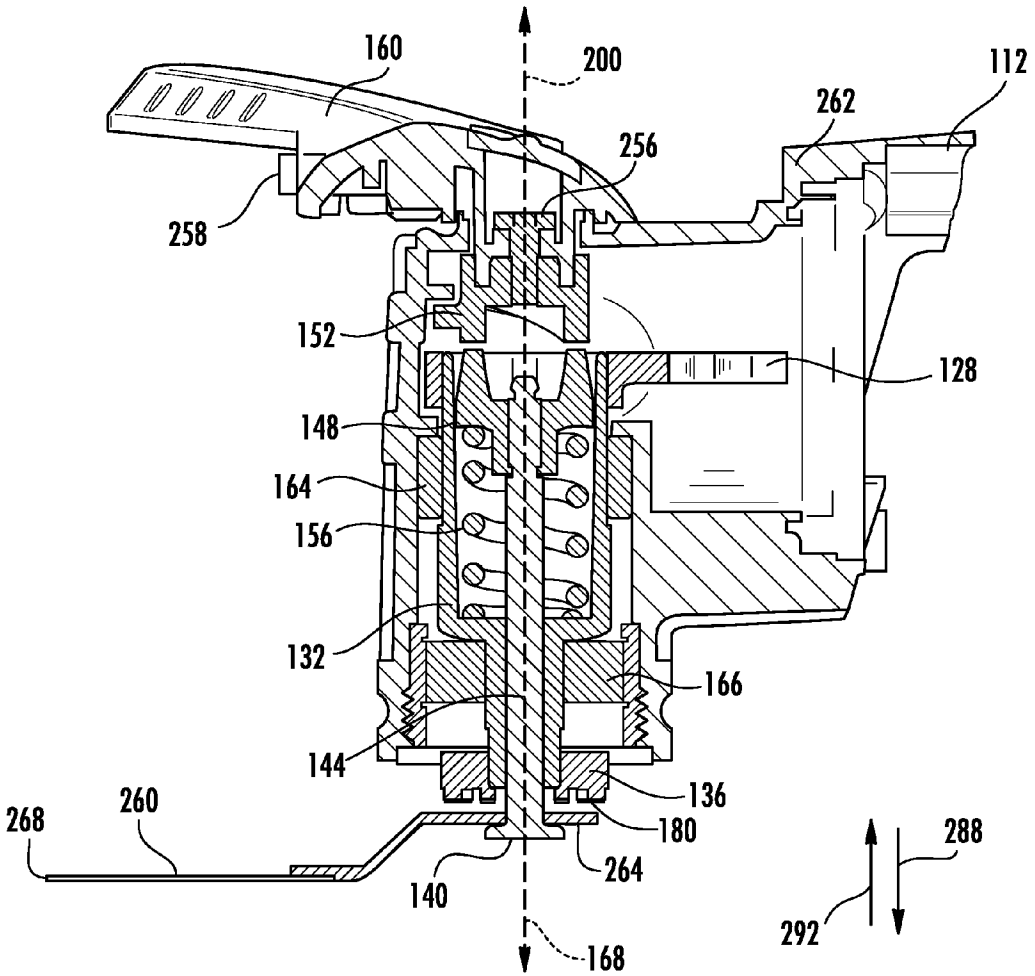
FIG. 9 is a cross sectional view of the front portion of the power tool of FIG. 1, showing the clamping device in the unclamped position.

The cam 152 is rotatably positioned within the housing 112 for rotation about the center point 224 between a clamped position (FIGS. 2 and 3) and an unclamped position (FIG. 9). When the cam 152 is in the clamped position the clamping device 108 is in the clamped position, and when the cam is in the unclamped position the clamping device is in the unclamped position.

Figure 8:
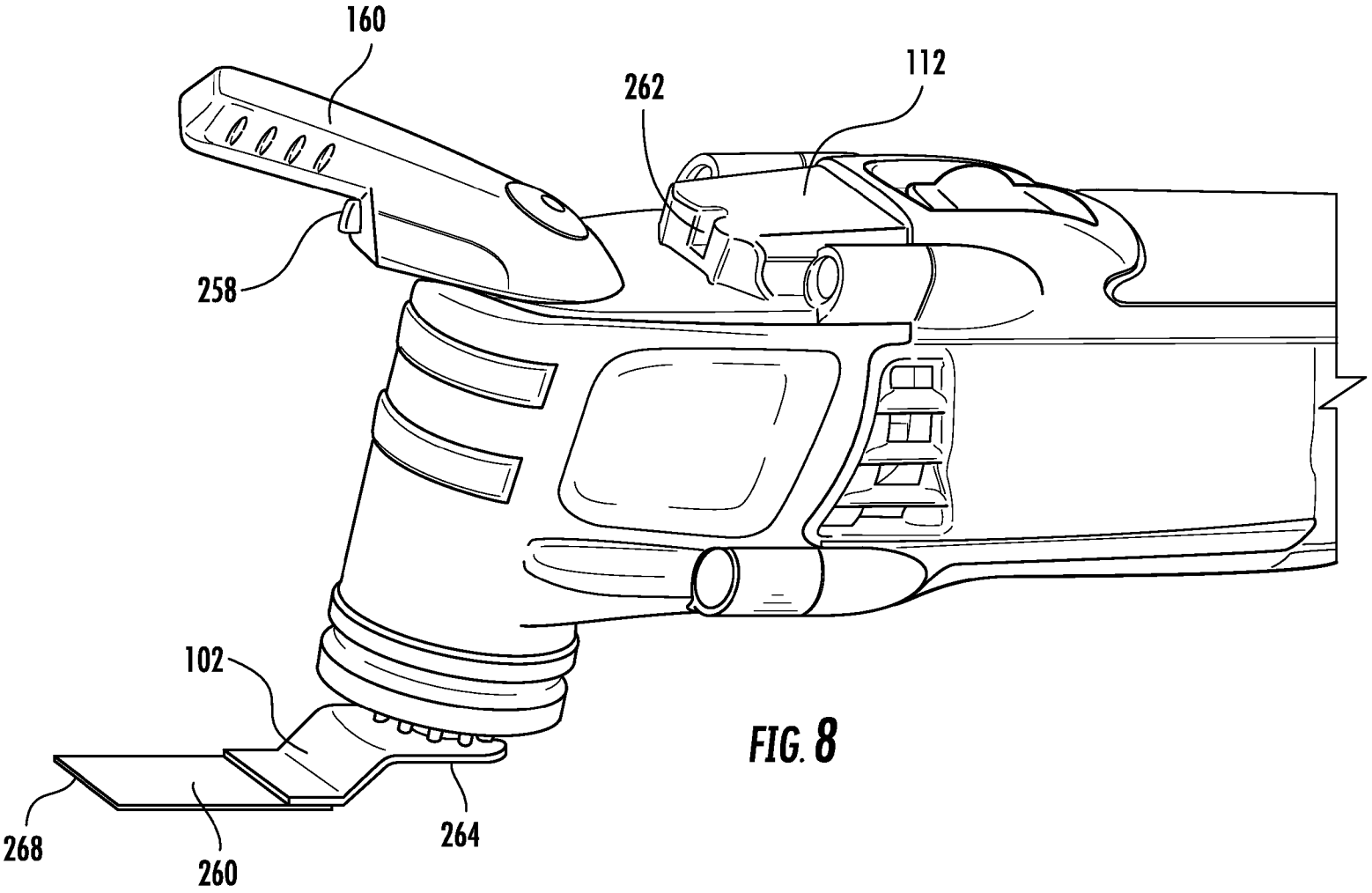
FIG. 8 is a perspective view of a portion of the power tool of FIG. 1, showing the clamping device in an unclamped position.

With reference again to FIG. 3, the handle 160 of the clamping device 108 is connected to the cam 152 with a fastening member shown as a screw 256, such that rotation of the handle results in rotation of the cam. The handle 160 is shown in FIGS. 2 and 3, with the clamping device 108 in the clamped position, and the handle is shown in FIGS. 8 and 9, with the clamping device in the unclamped position. As shown in FIG. 8, the handle 160 includes a lock tab 258 that interacts with a detent 262 formed in the housing 112 to secure the handle and the clamping device 108 in the clamped position.

As shown in FIG. 3, the biasing spring 156 is a compression spring positioned in the cavity 172 of the spool 132 between a bottom seat 266 of the spool and the follower member 148. The spring 156 biases the follower member 148, the inner flange 140, and the spindle 144 toward the cam 152 for each position of the cam. When the outer flange 136 has received an accessory bit 102 and the clamping device 108 is in the clamped position, the biasing spring 156 biases the inner flange 140 against the accessory bit, thereby clamping the accessory bit between the inner flange and the outer flange.

The components of the clamping device 108 are formed from hard and wear resistant materials. Accordingly, the spool 132, the outer flange 136, the inner flange 140, the spindle 144, the follower 148, and the cam 152 may be formed from metal, hard plastics, and/or other like materials as known by those of ordinary skill in the art.

Referring to FIGS. 4 and 8, the accessory bit 102 is provided as an oscillating tool accessory bit including a cutting portion 260 and a connection portion 264. The cutting portion 260 has a working end 268 (FIG. 8) for shaping/cutting a workpiece (not shown). As shown in FIG. 4, the connection portion 264 is received by the outer flange 136 and defines a spindle opening 272, a spindle slot 276, and a plurality of protrusion openings 280. The spindle opening 272 is a generally circular opening having a diameter that is greater than the maximum diameter of the spindle 144 and that is smaller than the diameter of the inner flange 140. A center point 284 of the spindle opening 272 is aligned with the center point 192 of the inner flange 140 when the accessory 102 is clamped to the power tool 100. The spindle slot 276 has a width that is greater than the diameter of the spindle 144 to enable the accessory 102 to be received and removed from the spindle. The protrusion openings 280 are positioned around the center point 284 in alignment with the protrusions 180 on the outer flange 136. The protrusion openings 280 are sized to receive the protrusions 180 with very little clearance between the protrusions 180 and the protrusion openings 280.

In operation, the clamping device 108 securely clamps the accessory bit 102 to the power tool 100, and is quickly and easily manipulated to release the accessory bit from the power tool. As shown in FIG. 3, the clamping device 108 is in the clamped position without an accessory bit 102 clamped between the outer flange 136 and the inner flange 140. To connect an accessory bit 102 to the power tool 100 the clamping device 108 is first moved to the unclamped position by rotating the handle 160 approximately 140° to 190°, and in one particular embodiment about 150°. No separate tools are needed to move the clamping device 108 to the unclamped position.

Movement of the clamping device 108 from the clamped position to the unclamped position, results in the inner flange 140 being moved in a downward direction 288 (FIG. 9) away from the outer flange 136. In particular, rotation of the handle 160 results in rotation of the cam member 152 relative to the follower 148. Accordingly, as the cam member 152 is rotated toward the unlocked position, the portions of the inclined surfaces 232, 236 in contact with the follower surfaces 212, 216 are positioned increasingly further in the downward direction 288, thereby forcing the follower 148, the spindle 144, and the inner flange 140 to move in the downward direction against the force of the biasing spring 156 to the position shown in FIG. 9. In this way, the profile of the cam surface 228 determines the distance that the inner flange 140 moves as the handle is moved from the clamped position to the unclamped position.

When the handle 160 reaches the unclamped position, the protrusions 204, 208 become seated in the detents 240, 244 in the cam member 152 under the force of the biasing spring 156. The handle 160 is moved easily to the unclamped position since the inclined surfaces 232, 236 of the cam surface 228 offer a mechanical advantage when compressing the biasing spring 156, and also since the length of the handle offers a mechanical advantage when rotating the cam 152. Therefore, the clamping device 108 is operable by users of virtually all skill levels including users with reduced manual dexterity.

As shown in FIG. 9, when the clamping device 108 is in the unclamped position the inner flange 140 is separated from the outer flange 136 and the accessory bit 102 may be received by the outer flange. To connect the accessory bit 102 to the outer flange 136 the spindle 144 is moved through the spindle slot 276 (FIG. 4) and into the spindle opening 272 (FIG. 4). Next, the protrusion openings 280 are aligned with the protrusions 180 and the connection portion 264 is moved in an upward direction 292 (FIG. 9) until the protrusions extend through the protrusion openings. The spindle 144 is not removed from the power tool 100 during connection of the accessory bit 102 to the power tool.

With the accessory bit 102 received by the outer flange 136, the handle 160 is moved to the clamped position to clamp the connection portion 264 of the accessory bit 102 between the inner flange 140 and the outer flange. The cam 152 is rotated relative to the follower 148 as the handle 160 is moved to the clamped position. As the cam 152 is rotated, the protrusions 204, 208 exit the detents 240, 244 and the portions of the inclined surfaces 232, 236 in contact with the protrusions are moved increasingly further in the upward direction 292. During this time, the biasing spring 156 maintains the follower surfaces 212, 216 of the protrusions 204, 208 against the inclined surfaces 232, 236, such that the follower member 148, the spindle 144, and the inner flange 140 move in the upward direction 292 relative to the outer flange 136 under the force of the biasing spring. This movement brings the inner flange 140 into contact with the accessory 102. When the handle 160 is rotated to the clamped position the biasing spring 156 forces the inner flange 140 firmly in the direction of the outer flange 136 to clamp the connection portion 264 between the inner flange and the outer flange. Also in the clamped position, an air gap 290 may be formed between the cam 152 and the follower 148, such that the cam surface 228 does not contact the follower surfaces 212, 216 when the clamping device 108 is in the clamped position.

After the accessory bit 102 is clamped to the power tool 100, the electric motor 116 may be energized to cause the accessory bit to oscillate. With reference to FIG. 2, the oscillation of the drive lever 128 causes the spool 132 to oscillate. The oscillation of the spool 132 is transferred to the outer flange 136 and to the connection portion 264 of the accessory bit 102. The working end 268 of the oscillating accessory bit 102 may be placed in contact with a workpiece to cut or shape the workpiece. In general, the accessory bit 102 oscillates through a range of approximately two to three degrees.

With reference to FIGS. 5 and 6, the offset position of the inner flange 140 in relation to the axis of oscillation 168 along with the chamfered edge 196 enables the clamping device 108 to clamp the accessory bit 102 to the power tool 100 with a substantially zero-clearance connection (i.e. with substantially zero "play" between the accessory bit and the outer flange 136). When the clamping device 108 is moved to the clamped position the chamfered edge 196 contacts the spindle opening 272. Upon initial contact the center point 192 of the inner flange 140 and the center point 284 of the spindle opening 272 are offset. However, since the chamfered edge 196 is biased against the spindle opening 272 by the biasing member 156, a force is exerted on the connection portion 264 in a direction that tends to move the center point 284 of the connection portion into alignment with the center point 192 of the inner flange 140. Accordingly, this force causes the inner flange 140 to bias the protrusion openings 280 firmly against the side surfaces 188 of the protrusions 180 and to establish the substantially zero-clearance connection.

The substantially zero-clearance connection between the outer flange and the accessory bit 102 increases the efficiency of the torque transferred from the drive system 104 to the accessory bit. The increase in efficiency is exhibit by increased oscillation in the working end 268 of the accessory bit 102 and less heat generated between the connection portion 264 and the clamping device 108, as compared to other similar power tools.

The side surfaces 188 of the protrusions 180 also increase the efficiency of the torque transferred from the drive system 104 to the accessory bit 102 under some load conditions of the accessory bit. As shown in FIG. 5 the connection portion 264 is seated firmly against the contact surface 184 of the outer flange 136. Under some load conditions, however, the connection portion 264 may be moved away from the contact surface 184. Nonetheless, the substantially zero-clearance connection is maintained between the connection portion 264 and the outer flange 136 due to the perpendicularly extending side surfaces 188, which maintain full contact with the protrusion openings 280 even when the connection portion 264 is not completely seated on the contact surface 184.

Figure 10:
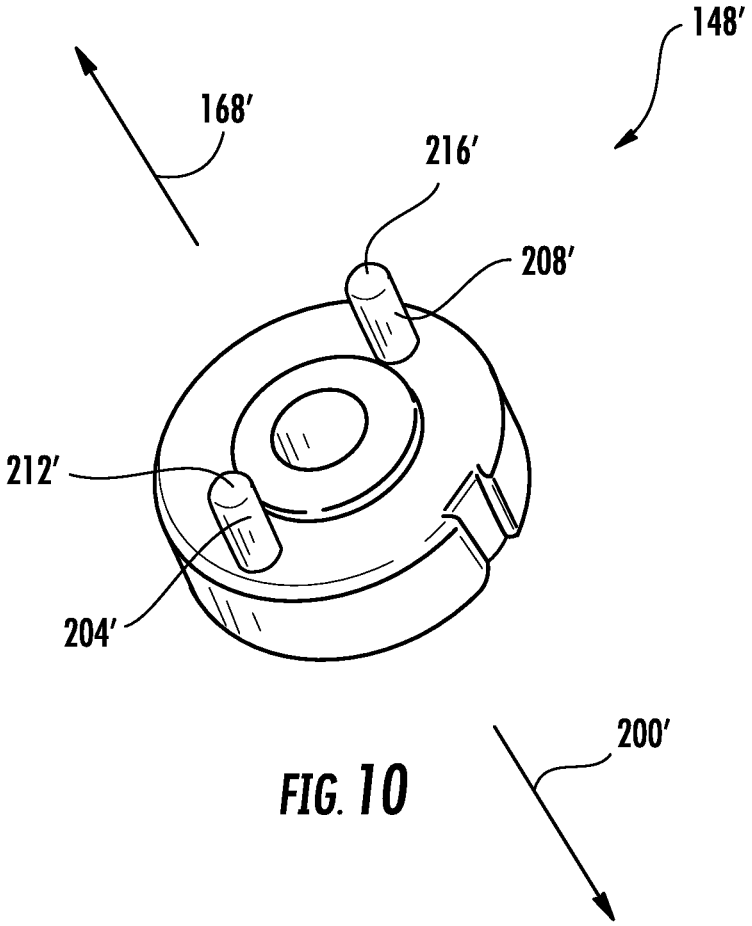
FIG. 10 is a perspective view of an alternative embodiment of the follower member for use with the clamping device of the power tool of FIG. 1.

FIG. 10 shows another embodiment of the follower 148'. The follower 148' functions in the same manner as the follower 148, except that the protrusions 204', 208' of the follower 148' are fixedly connected to the follower member 148' instead of being integrally formed therewith. The protrusions 204', 208' are generally cylindrical and include a rounded-over contact surface 212', 216' that interacts with the cam surface 228.

Figure 11:
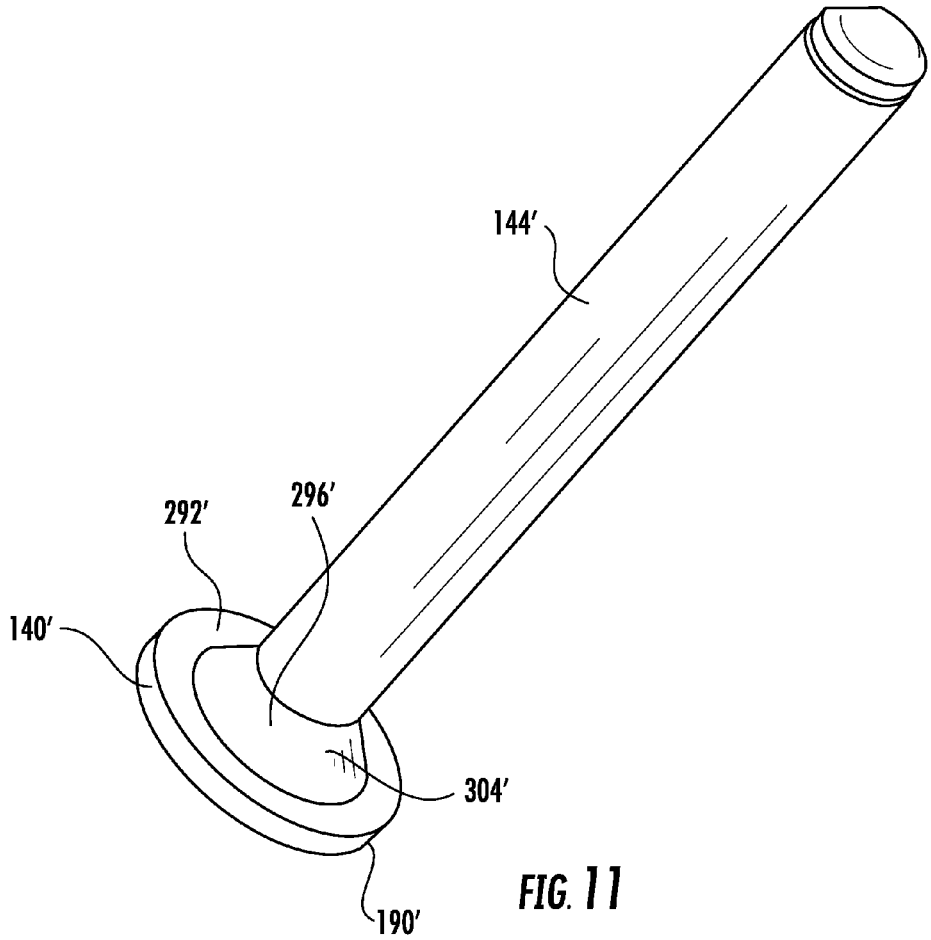
FIG. 11 is a perspective view of an alternative embodiment of a spindle for use with the clamping device of the power tool of FIG. 1, the spindle includes an eccentric member positioned near a flange of the spindle.
Figure 12:
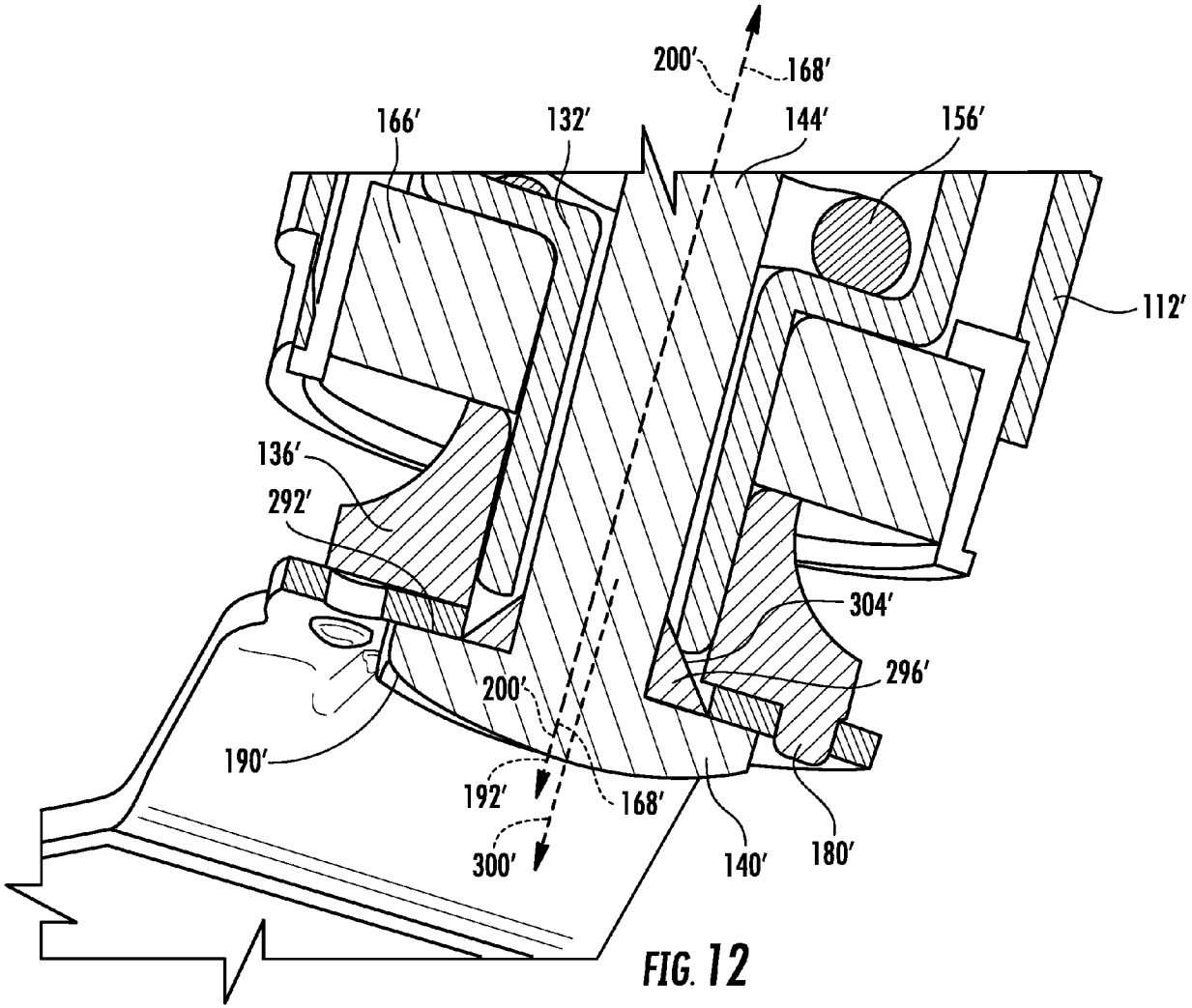
FIG. 12 is a cross sectional view of a portion of an alternative embodiment of the clamping device of the power tool of FIG. 1 including the spindle and the eccentric member of FIG. 11.

FIGS. 11 and 12, show another embodiment of the inner flange 140', which includes a flange surface 292' and an eccentric member 296'. The inner flange 140' defines a generally circular periphery 190' having a center point 192' (FIG. 11) that is coaxial with the axis of oscillation 168 and the longitudinal axis 200'. The flange surface 292' contacts the accessory bit 102 when the clamp device 108 is in the clamped position.

The eccentric 296' is positioned on the flange surface 292' and has a center point 300' that is offset from the axis of oscillation 168'. The center point 300' of the eccentric 296' may be determined in numerous ways as known by those of ordinary skill in the art, including by determining the centroid of the eccentric. The eccentric 296' has a chamfered edge 304' that engages the spindle opening 272 of the accessory bit 120 in a manner similar to the manner in which the chamfered edge 196 engages the spindle opening 272 to cause the protrusion openings 280 to be biased against the protrusions 180. The eccentric 296' may be formed from materials including metal, hard plastics, and the like.

While the power tool 100 has been illustrated and described in detail in the drawings and foregoing description, the same should be considered as illustrative and not restrictive in character. For example, the power tool 100 has been described as an oscillating power tool; however, the power tool may also be provided as a rotary tool configured to rotate the accessory bit 102. It is understood that only the preferred embodiments have been presented and that all changes, modifications and further applications that come within the spirit of the disclosure are desired to be protected.

What is claimed is:

1. A clamping device for clamping an accessory to a power tool comprising:

a first flange coupled to a drive system of the power tool and configured to receive the accessory;

a spindle member defining a longitudinal axis and including a second flange provided on an end of said spindle member and a follower member provided on an opposite end of said spindle member, said second flange defining a circular periphery and a center point that is misaligned with said longitudinal axis; and a cam member including a cam surface configured to interact with said follower member, said cam member being rotatable about said longitudinal axis to a clamped position and to an unclamped position, in said unclamped position the accessory is removable from said first flange, and in said clamped position the accessory is clamped between said first flange and said second flange.

2. The clamping device of claim 1, further comprising:

a biasing member positioned between said follower member and said second flange, said biasing member configured to urge said second flange toward said first flange.

3. The clamping device of claim 1, wherein:

said cam member defines a circular periphery aligned with said longitudinal axis, and said cam surface extends from said circular periphery of said cam member and extends substantially completely around said longitudinal axis.

4. The clamping device of claim 3, wherein:

said cam surface includes a first inclined surface and a second inclined surface, and said follower member includes a first protrusion configured to interact with said first inclined surface and a second protrusion configured to interact with said second inclined surface.

5. The clamping device of claim 1, wherein:

said first flange includes a plurality of protrusions configured to be received by a plurality of protrusion openings formed in the accessory, and said spindle member includes a chamfered portion configured to bias the plurality of protrusion openings against the plurality of protrusions when the cam member is in the clamped position.

6. The clamping device of claim 5 wherein:

said accessory defines a spindle opening through which said spindle member is configured to extend when said first flange receives said accessory, and a wide portion of said chamfered portion is wider than said spindle opening defined by said accessory and contacts said spindle opening defined by said accessory when said cam member is in said clamped position.

7. The clamping device of claim 1, wherein said cam member defines a detent configured to receive at least a portion of said follower member when said cam member is in said unclamped position.

8. A clamping device for clamping an accessory to a power tool comprising:

a first flange coupled to a drive system of the power tool and configured to receive the accessory;

a spindle member defining a longitudinal axis and including a second flange provided on an end of said spindle member and a follower member provided on an opposite end of said spindle member; and a cam member including a cam surface configured to interact with said follower member, said cam member being rotatable about said longitudinal axis to a clamped position and to an unclamped position, in said unclamped position the accessory is removable from said first flange, and in said clamped position the accessory is clamped between said first flange and said second flange and said cam surface is separated from said follower member.

9. A clamping device for clamping an accessory to a power tool, comprising:

a first clamp member coupled to a drive system of the power tool and including a plurality of protrusions configured to be received by a plurality of protrusion openings formed in the accessory;

an actuator rotatable about an axis of rotation to a clamped position and to an unclamped position; and a second clamp member movable in a direction parallel to said axis of rotation and defining a chamfered surface at least partially positioned against a spindle opening defined by the accessory, wherein when said actuator is rotated to said clamped position the accessory is clamped between said first clamp member and said second clamp member, and said chamfered surface biases the plurality of protrusion openings against said plurality of protrusions, and wherein the accessory is removable from said first clamp member when said actuator is rotated to said unclamped position.

10. The clamping device of claim 9, further comprising:

a spindle member extending from said second clamp member and defining an axis of oscillation that is aligned with said axis of rotation, wherein said second clamp member defines a circular periphery and a center point, and wherein said center point is offset from said axis of rotation and said axis of oscillation.

11. The clamping device of claim 9, further comprising a biasing member positioned between said actuator and said second clamp member, said biasing member configured to urge said second clamp member toward said first clamp member when said actuator is in said clamped position and when said actuator is in said unclamped position.

12. The clamping device of claim 9, wherein the power tool is a rotary power tool or an oscillating power tool.

* * * * *